US006705373B1

(12) United States Patent
Yu Chen

(10) Patent No.: US 6,705,373 B1
(45) Date of Patent: Mar. 16, 2004

(54) TAPE CUTTING DEVICE OF AN ADHESIVE-TAPE HOLDER

(76) Inventor: Hsiu-Man Yu Chen, No. 27, Sec. 1, Ta Fu Road, Tan Tzu Hsiang, Taichung (TW), 427

( * ) Notice: Subject to any disclaimer, the term of this patent is extended or adjusted under 35 U.S.C. 154(b) by 0 days.

(21) Appl. No.: 10/285,530

(22) Filed: Nov. 1, 2002

(51) Int. Cl.[7] ..... B32B 31/00

(52) U.S. Cl. ..... 156/523; 156/577; 156/579; 225/22; 225/89

(58) Field of Search ..... 156/574, 577, 156/579, 576, 523, 527, 526; 225/46, 23, 56, 91, 21, 22, 89

(56) References Cited

U.S. PATENT DOCUMENTS 5,393,367 A * 2/1995 Yu Chen ..... 156/523
5,641,377 A * 6/1997 Chung et al. ..... 156/577
6,540,002 B1 * 4/2003 Edwards et al. ..... 156/577

* cited by examiner

*Primary Examiner*—Richard Crispino
*Assistant Examiner*—Cheryl N. Hawkins
(74) *Attorney, Agent, or Firm*—Troxell Law Office PLLC

(57) ABSTRACT

The tape cutting device of an adhesive-tape holder includes a press member provided at the front upper side of the handle of an adhesive-tape holder. The press member can be pressed to push a blade to move forward and cut off an adhesive tape precisely. After the press member is actuated to move to a preset location to let the blade carry out cutting an adhesive tape, it will recover its original position by the resiliency of a spring, able to cut off an adhesive tape precisely by a pressing force of a user's fingers, conforming to ergonomics and convenient in handling.

7 Claims, 5 Drawing Sheets

TAPE CUTTING DEVICE OF AN ADHESIVE-TAPE HOLDER

BACKGROUND OF THE INVENTION

This invention relates to the tape cutting device of an adhesive-tape holder, particularly to one provided with a press member which can be pressed to push a blade to move forward and cut off an adhesive tape precisely, convenient in use and able to be handled smoothly.

The automatic tape cutting device of a conventional adhesive-tape holder, as disclosed in a Taiwan Patent No.5641377 titled "RETRACTABLE BLADE HAND HELD TAPE APPLICATION" issued on Jul. 24 in 1977, includes a blade and a press plate combined together. The press plate is pressed by the force of a user's wrist to push the blade to move forward to cut an adhesive tape, always making a user's wrist uncomfortable and unable to cut off an adhesive tape precisely and smoothly because the press plate is made of elastic plastic.

SUMMARY OF THE INVENTION

This invention is devised to offer a tape cutting device of an adhesive-tape holder, having a press member additionally provided at a predetermined location of an adhesive-tape holder to be pressed by a user's fingers to move a blade outward and carry out cutting, able to cut off an adhesive tape precisely, avoiding retracting of the adhesive tape and be handled smoothly and comfortably.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
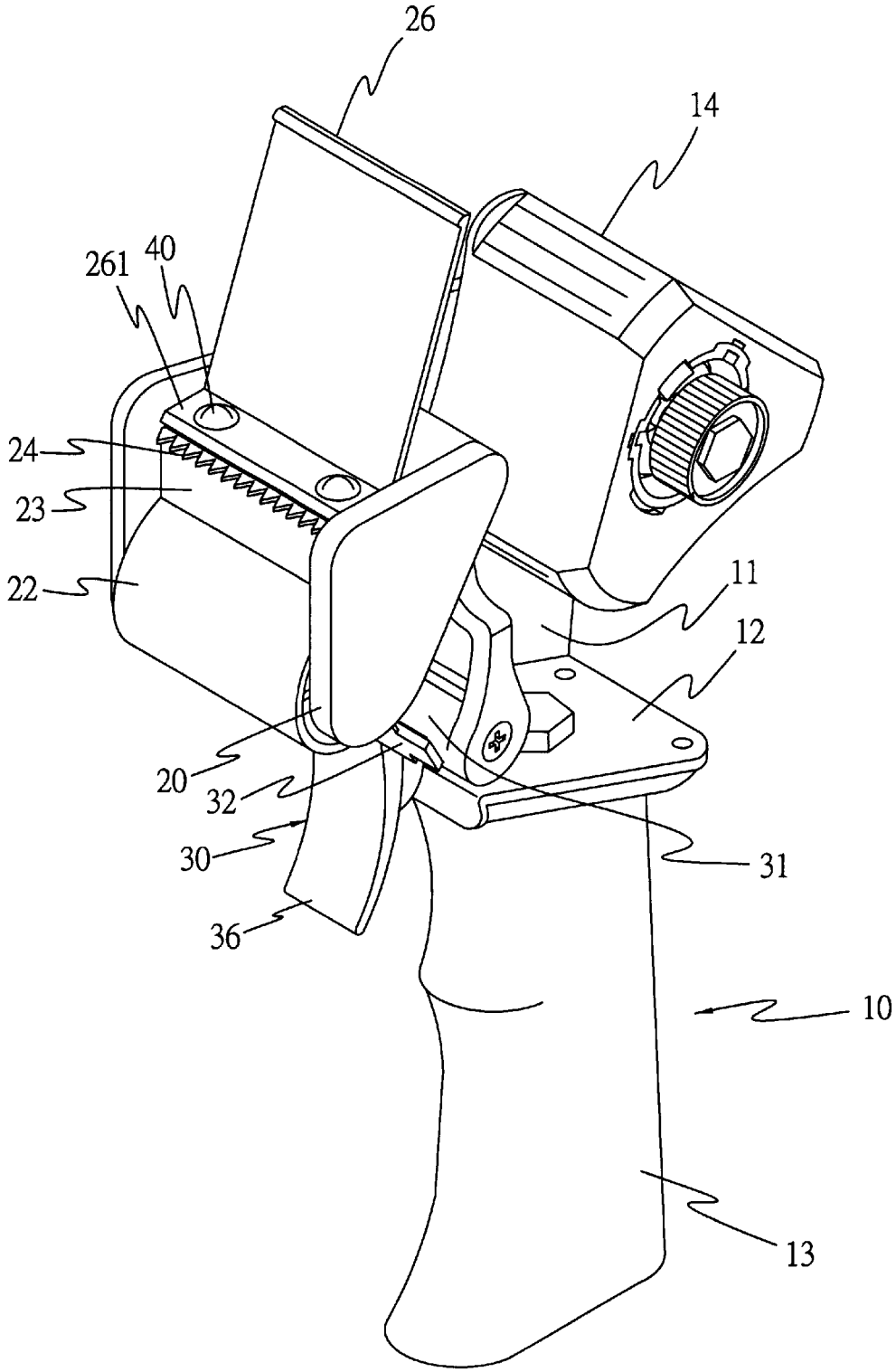
FIG. 1 is a perspective view of an adhesive-tape holder in the present invention.

A preferred embodiment of the tape cutting device of an adhesive-tape holder in the present invention, as shown in FIG. 1, is provided at the front side of an adhesive-tape holder 10 which is composed of an inner plate 11, a handle 13, an adhesive-tape base 14, an outer plate 20 and a press member 30.

Figure 2:
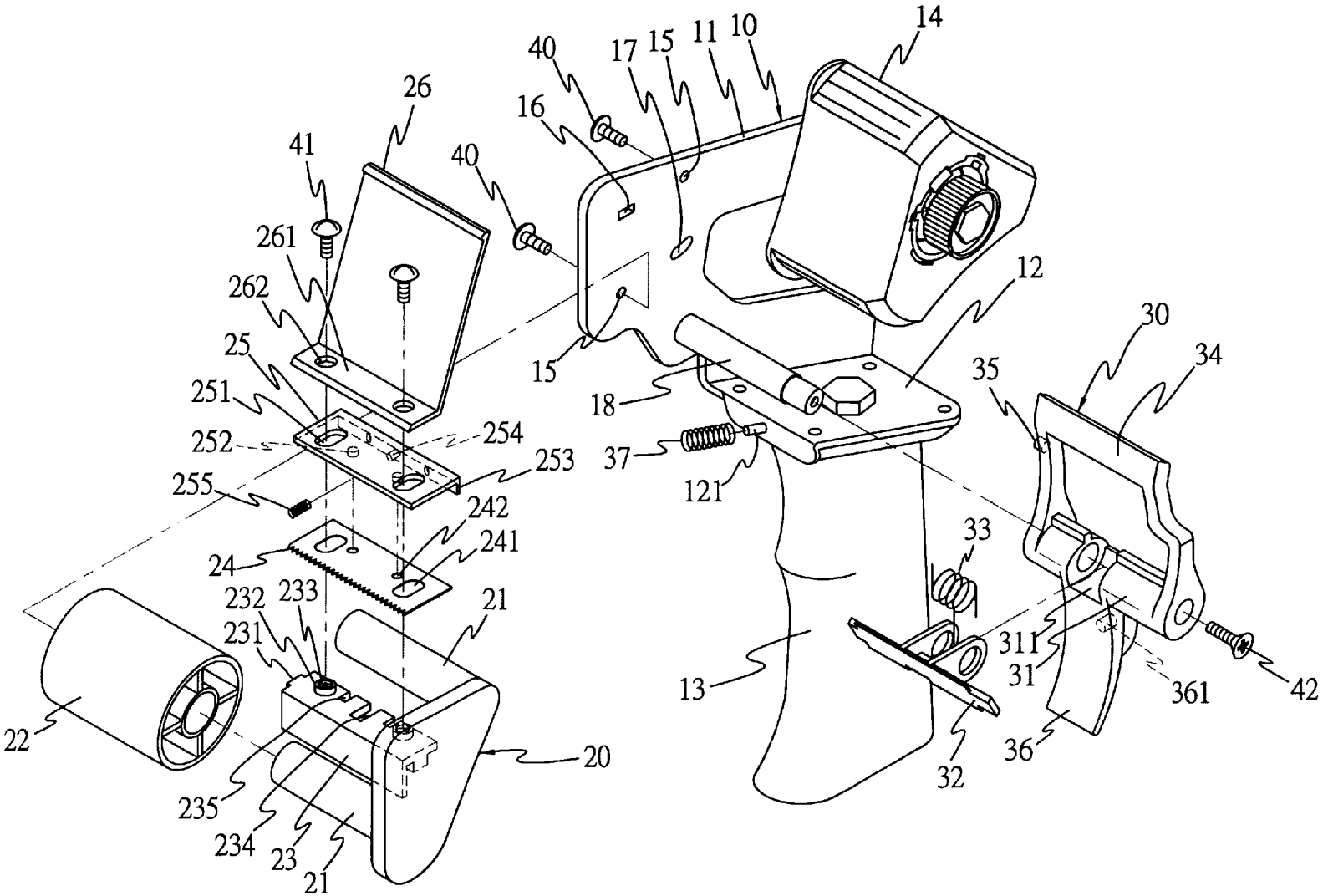
FIG. 2 is an exploded perspective view of the adhesive-tape holder in the present invention.

The inner plate 11 , as shown in FIG. 2, is formed at its bottom side with a bottom base 12 extending outward horizontally, and a handle 13 is provided under the bottom base 12, with a round stud 121 protruding outward on the front center. An adhesive-tape base 14 is disposed at the rear side of the adhesive-tape holder 10 for a tape roll fitted around thereon. Besides, the inner plate 11 has two threaded holes 15 and a fitting hole 16 bored near its front end, an arcuate position-limiting slot 17 bored in the center and a support shaft 18 provided horizontally at a lower side.

The outer plate 20 is provided with two horizontal pivotal shafts 21 respectively at a front and a rear side to be respectively screwed together with the two threaded holes 15 of the inner side plate 11 by bolts 40, with the front pivotal shaft 21 mounted thereon with a cylinder-shaped roller 22. The outer plate 20 is further fixed on a front upper side with a blade holder 23 having an fitting block 231 formed at the outer side to be stably fitting in the fitting hole 16 of the inner plate 11 of the adhesive-tape holder 10. The blade holder 23 is provided on top with two fixing studs 232 protruding upward and respectively having a threaded hole 233, a receiving groove 234 in the center and two slide grooves 235 respectively positioned at the left side and the right side of the receiving groove 234.

A blade 24 to be mounted on the blade holder 23 is bored with two oval slide slots 241 to be respectively fitted around the two fixing studs 232 of the blade holder 23 to enable the blade 24 to move back and forth thereon. The blade 24 is further provided with two position holes 242. An L-shaped slide base 25 to be disposed on the blade 24 is provided with two slide slots 251 matching with the two fixing studs 232 of the blade holder 23, having two engage studs 252 protruding downward under the bottom to respectively pass through the two position holes 242 of the blade 24 and positioned in the two slide grooves 235 of the blade holder 23 to let the blade 24 shift within a defined stroke. In addition, the slide base 25 is formed with a vertical push plate 253 extending downward from the rear edge and having a stud 254 protruding inward on the inner wall and fitting in one end of a spring 255 which has the other end stably positioned in the receiving groove 234 of the blade holder 23. Further, an L-shaped press plate 26 to be positioned on the slide base 25 has its bottom portion formed as a flat support plate 261 having two lengthwise round holes 262 for two bolts 41 to be screwed therethrough.

Figure 3:
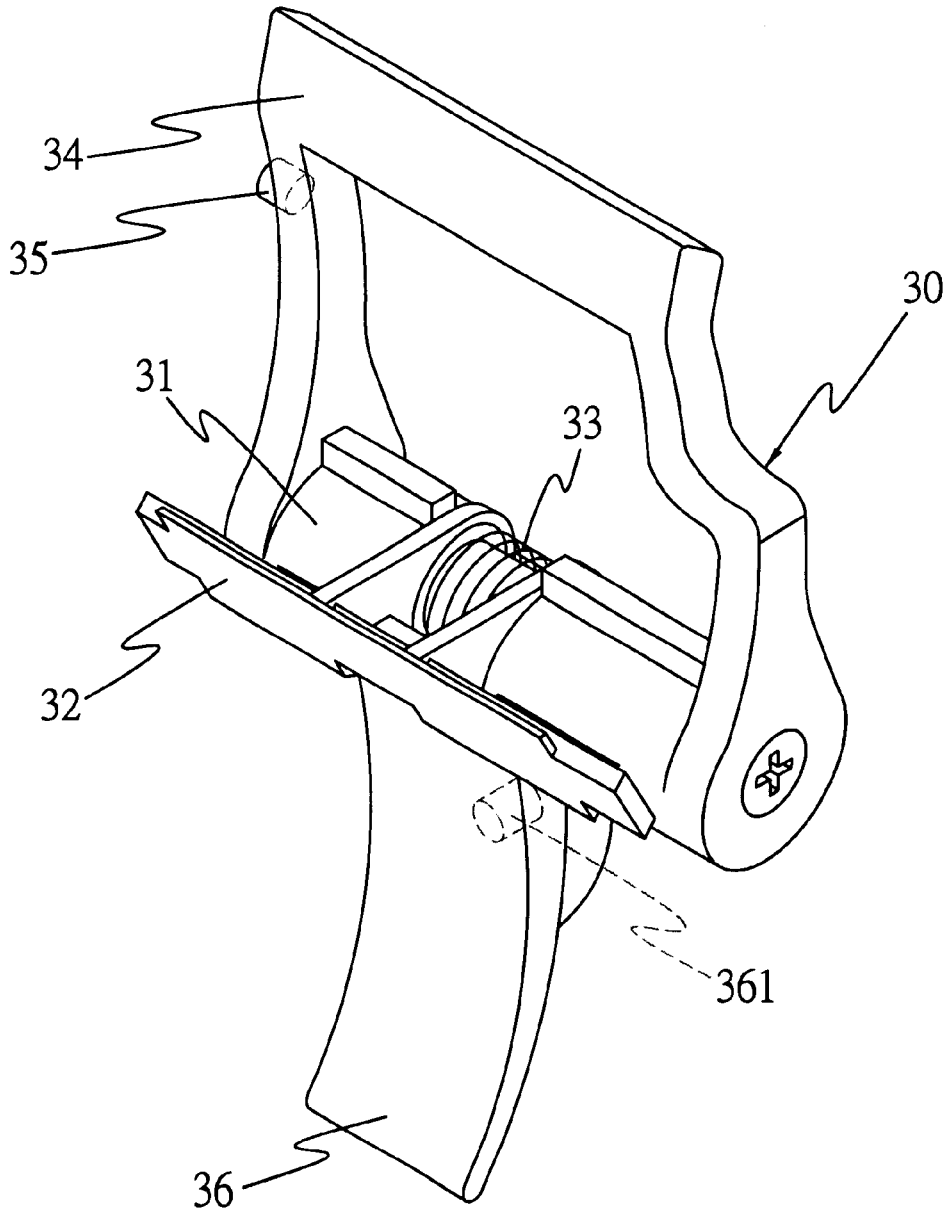
FIG. 3 is a perspective view of the press member of the adhesive-tape holder in the present invention.

The press member 30 positioned in front of the handle 13, as shown in FIGS. 2 and 3, is provided with a shaft combining portion 31 at the center for a support shaft 18 of the inner plate 11 to be fitted therein and fixed by a bolt 42. The shaft combining portion 31 is formed with an accommodating groove 311 in the center for a holding plate 32 to be pivotally connected therein. The holding plate 32 has a torsion spring 33 combined at its rear side so as to supply the holding plate 32 with elasticity so as to prop up an adhesive tape by its front edge. Besides, the press member 30 is provided with an actuating plate 34 on top for pressing and pushing the push plate 253 to move the slide base 25 forward and a position-limiting stud 35 at one side edge facing the adhesive-tape holder 10 to movably fit in the position-limiting slot 17 of the inner side plate 11. In addition, the press member 30 is formed with a pull plate 36 extending downward to be pressed by a user's fingers and having a fixing stud 361 on the rear side, with a spring 37 fitted between the fixing stud 361 of the pull plate 36 and the round stud 121 of the bottom base 12.

Figure 4:
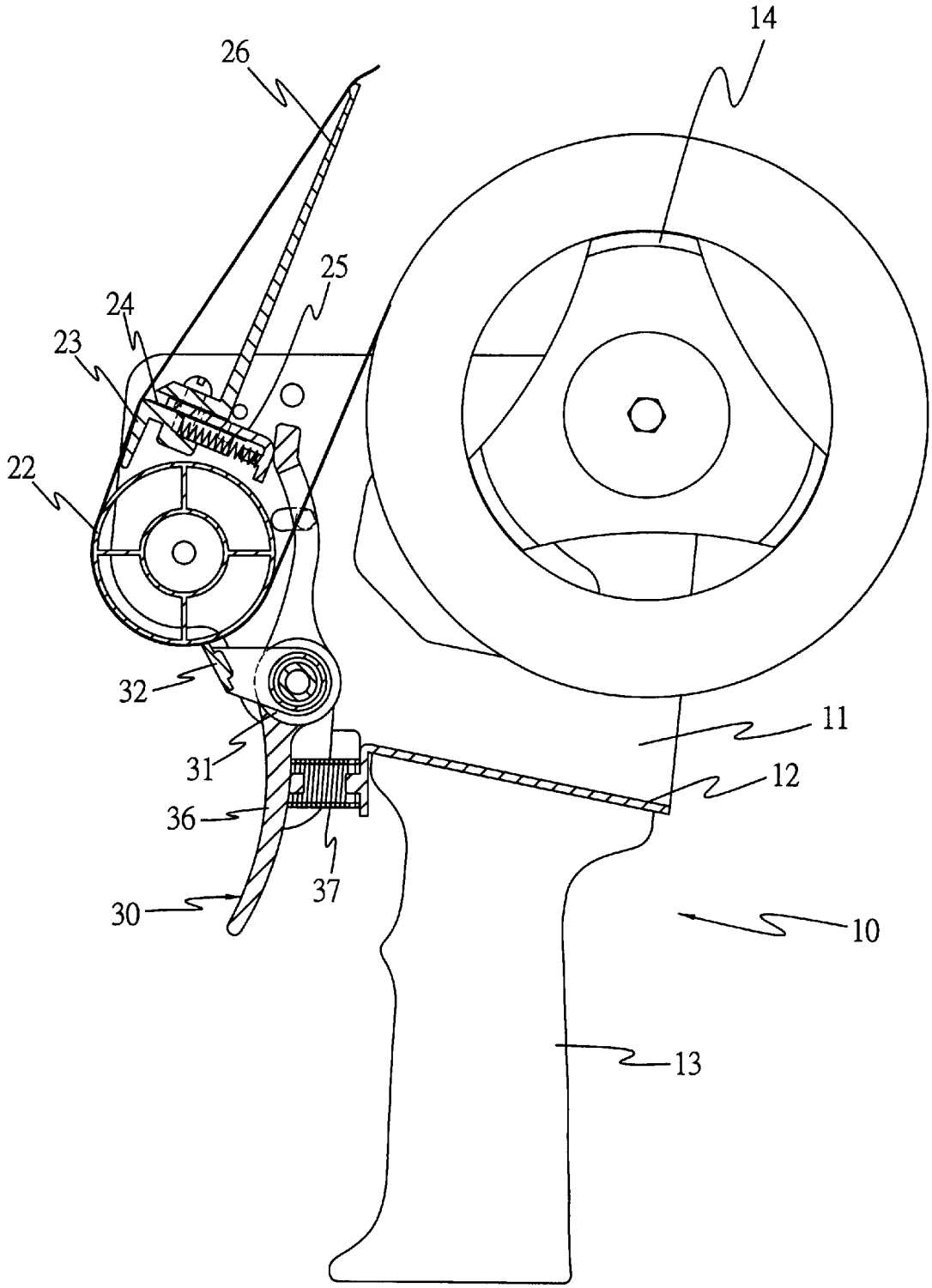
FIG. 4 is a side cross-sectional view of the tape cutting device in the present invention, illustrating that the blade of a tape cutting device is not yet pushed outward.
Figure 5:
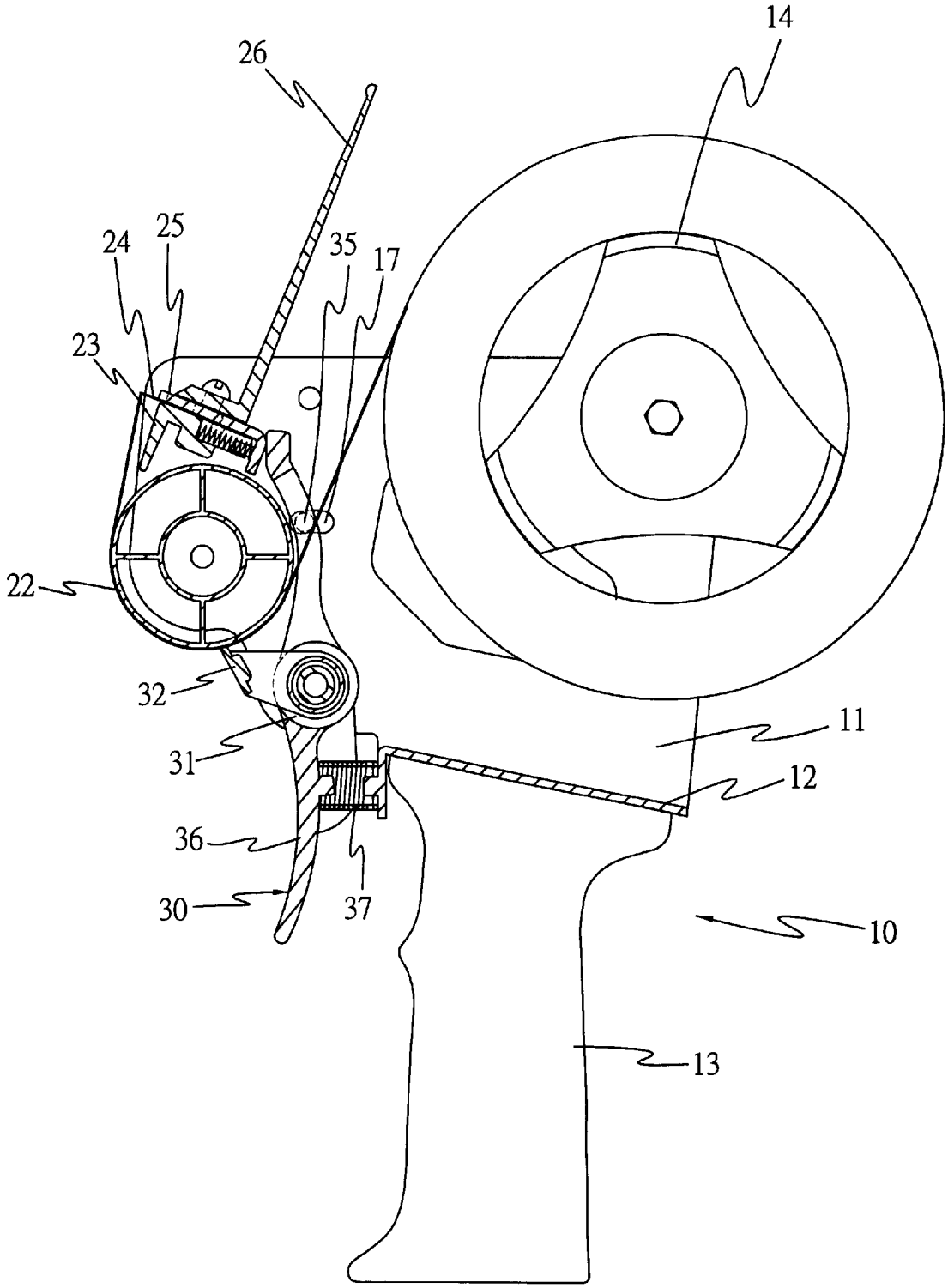
FIG. 5 is a side cross-sectional view of the tape cutting device in the present invention, illustrating that the blade of the tape cutting device is pushed outward.

In assembling and using, as shown in FIGS. 4 and 5, the press member 30 has its shaft combining portion 31 fitted around the support shaft 18 of the inner side plate 11. Thus, when the pull plate 36 of the press member 30 is pressed, the press member 30 will rotate around the support shaft 18, which functions as a fulcrum, and its upper actuating plate 34 will shift forward and push the slide base 25 together with the blade 24 to move forward and subsequently cut off an adhesive tape. The position-limiting stud 35 of the press member 30 fitting in the arcuate position-limiting slot 17 of the inner side plate 11 is limited to shift within the defined stroke, and at the same time the slide base 25 is restricted to move by the slide grooves 23.5 of the blade holder 23 and the slide holes 241 of the blade 24 and also by the slide slots 251 of its own, the re fore the blade 24 is able to cut off an adhesive tape precisely.

After the blade 24 finishes cutting of an adhesive tape and the pull plate 36 is released, the press member 30 as well as its actuating member 34 will recover its original position by the resiliency of the spring 37. Then the slide base 25 will also move back to its original location by the resilience of the spring 255 to let the blade 24 retract in the blade holder 23 to prevent a user's hand from being cut and ensure safety in handling.

Additionally, the holding plate 32 has its rear end received in the accommodating groove 311 of the press member 30 and actuated by the torsion spring 33 to let its front end elastically prop up stably an adhesive tape to prevent the adhesive tape from retracting and adhering to a tape roll or falling off.

While the preferred embodiment of the invention has been described above, it will be recognized and understood that various modifications may be made therein and the appended claims are intended to cover all such modifications that may fall within the spirit and scope of the invention.

I claim:

1. The tape cutting device of an adhesive-tape holder comprising an inner side plate, a handle, an adhesive-tape base, an outer side plate and a press member and characterized by:

a blade holder provided at a front upper side of said outer plate; a blade pivotally mounted on said blade holder; said blade able to move back and forth on said blade holder; a slide base having its bottom side positioned on said blade, said slide base able to move together with said blade within a defined distance; a spring positioned between said slide base and said blade holder, said spring elastically pushing said slide base and said blade to move back to their original positions after a pressing force on said spring disappears;

a support shaft provided at a preset location of the adhesive-tape holder; a shaft combining portion of the press member rotatably mounted around said support shaft, said press member formed with an actuating plate extending up from said shaft combining portion; a pull plate extending downward from said shaft combining portion said pull plate manually pressed to let said actuating plate push said slide base to move forward, said slide base actuating said blade to protrude out and cut an adhesive tape.

2. The tape cutting device of an adhesive-tape holder as claimed in claim 1, wherein a spring is positioned between said press member and said adhesive-tape holder to enable said press member to recover its original position automatically after released.

3. The tape cutting device of an adhesive-tape holder as claimed in claim 2, wherein said pull plate of said press member is provided with a fixing stud on the rear side, and the bottom base of said adhesive-tape holder is fixed with a round stud on the front center, with a spring having its opposite ends respectively fitted around said fixing stud and said round stud.

4. The tape cutting device of an adhesive-tape holder as claimed in claim 1, wherein an accommodating groove is provided in the center of said shaft combining portion of said press member for a holding plate to be pivotally fitted therein and said holding plate has its rear side provided with a torsion spring to supply said holding plate with elasticity so as to stably prop up an adhesive tape by its front end.

5. The tape cutting device of an adhesive-tape holder as claimed in claim 1, wherein an arcuate position-limiting slot is bored at a preset location in the center of said inner plate, and a position-limiting stud is fixed on the outer side edge of said press member to fit in said arcuate position-limiting slot to let said press member move within a limited stroke.

6. The tape cutting device of an adhesive-tape holder as claimed in claim 1, wherein said blade holder is provided with two fixing studs on top, and said blade is bored with two slide slots for receiving said two fixing studs of said blade holder, and said slide base is also bored with two slide holes to be fitted around by said two fixing studs, so that said slide base is able to move together with said blade within a limited stroke.

7. The tape cutting device of an adhesive-tape holder as claimed in claim 1, wherein said slide base is fixed with two engage studs protruding downward from the bottom, said blade is bored with two position holes for receiving said two engage studs, and said blade holder is provided with two slide grooves, with said two fitting studs respectively inserted through said two position holes and then fitting in said two slide grooves to let said blade move within a defined distance.

* * * * *